United States Patent [19]

Schweigert

[11] Patent Number: 5,037,462

[45] Date of Patent: Aug. 6, 1991

[54] PROCESS AND DEVICE FOR PRODUCTION OF NITROGEN

[75] Inventor: Karl H. Schweigert, Munich, Fed. Rep. of Germany

[73] Assignee: Linde Aktiengesellschaft, Wiesbaden, Fed. Rep. of Germany

[21] Appl. No.: 32,659

[22] Filed: Apr. 1, 1987

[30] Foreign Application Priority Data

Apr. 2, 1986 [DE] Fed. Rep. of Germany ..... 3610973

[51] Int. Cl.[5] ..... F25J 3/02

[52] U.S. Cl. ..... 62/24; 62/38; 62/43

[58] Field of Search ..... 62/9, 11, 23, 24, 25, 62/26, 27, 28, 29, 31, 32, 34, 38, 43, 44

[56] References Cited

U.S. PATENT DOCUMENTS

| | | | |
|---|---|---|---|
| 3,280,574 | 10/1966 | Becker | 62/13 |
| 3,620,032 | 11/1971 | Simonet | 62/28 |
| 3,886,758 | 6/1975 | Perrotin et al. | 62/26 X |
| 4,222,756 | 9/1980 | Thorogood | 62/29 X |
| 4,401,188 | 8/1983 | Patel et al. | 62/31 x |
| 4,530,708 | 7/1985 | Nakazoto et al. | 62/34 X |
| 4,566,887 | 1/1986 | Openshaw | 62/38 X |
| 4,594,085 | 6/1986 | Cheung | 62/34 X |

FOREIGN PATENT DOCUMENTS

| | | |
|---|---|---|
| 2854508 | 6/1980 | Fed. Rep. of Germany . |
| 3035844 | 5/1982 | Fed. Rep. of Germany . |
| 985068 | 3/1965 | United Kingdom . |

*Primary Examiner*—Ronald C. Capossela
*Attorney, Agent, or Firm*—Millen, White & Zelano

[57] ABSTRACT

In a process for production of nitrogen by low-temperature rectification of air, the air is compressed and divided into two partial streams of which the first partial stream is cooled and fed to a rectification zone, while the second partial stream is further compressed, cooled, expanded and then also fed to the rectification zone. The first partial stream, before it is fed to the rectification zone, is brought into heat exchange relation with the bottom liquid of the rectification zone. A nitrogen product stream is removed from an upper section of the rectification zone.

20 Claims, 1 Drawing Sheet

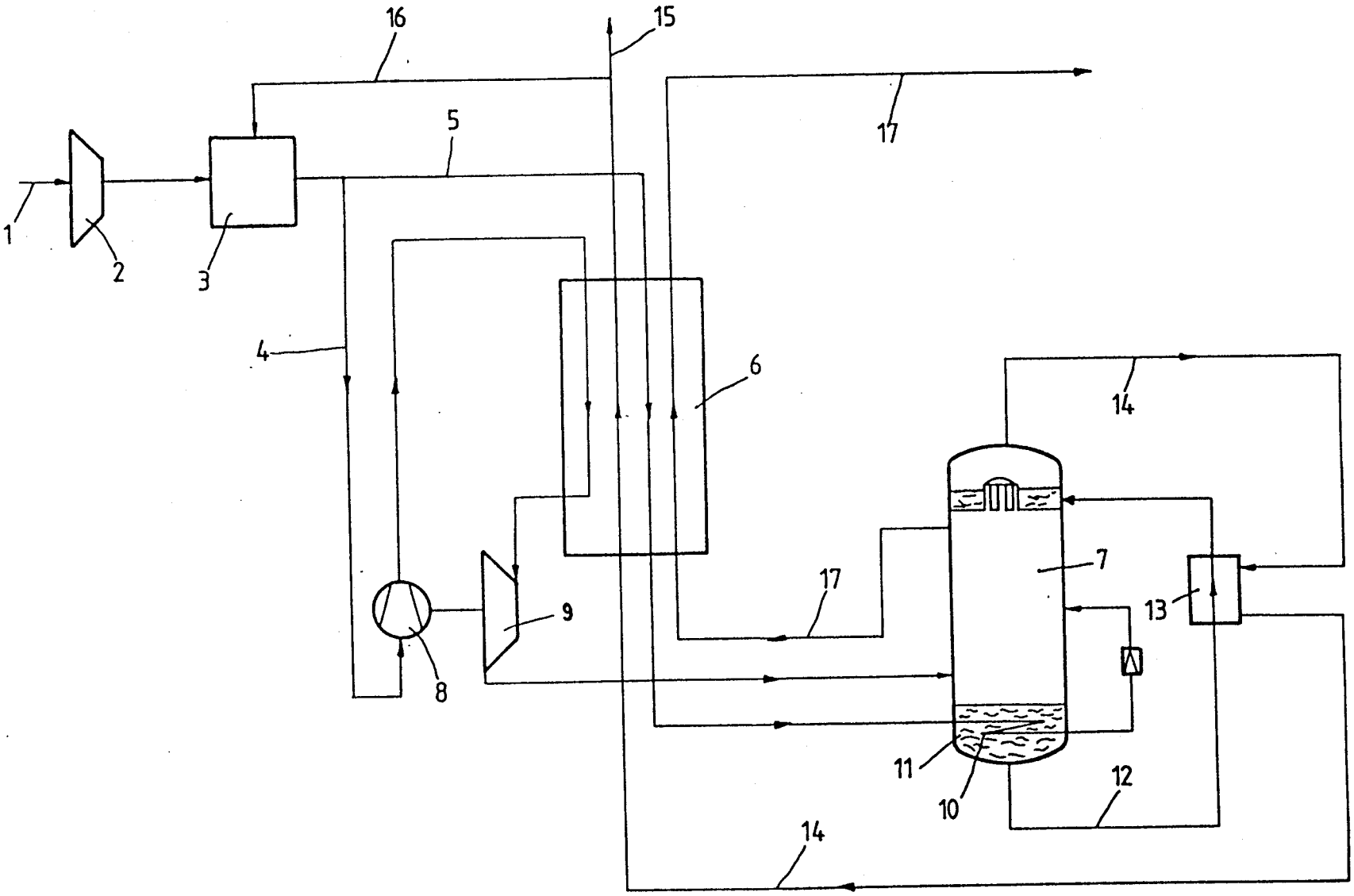
1
2
3
4
5
6
7
8
9
10
11
12
13
14
14
15
16
17
17

PROCESS AND DEVICE FOR PRODUCTION OF NITROGEN

BACKGROUND OF THE INVENTION

This invention relates to a process for the production of nitrogen by low-temperature rectification of air, in which the air feed stream is compressed and divided into two partial air streams, the first of which is cooled and fed to a rectification, while the second is separately further compressed, cooled, expanded and also fed to the rectification wherein a nitrogen product stream is discharged from an upper section of the rectification. The invention further relates to an apparatus for performing such a process.

A process of the type mentioned above is disclosed in DE-OS 30 35 844. This reference shows a process for obtaining oxygen of average purity, in which—especially in the embodiment according to FIG. 2—a nitrogen stream is obtained at basically atmospheric pressure. In this process the first partial air stream, after its cooling, is fed directly into a rectifying column. The second, further compressed, partial air stream, after its cooling, is brought into heat exchange with separation products still in heat exchange with the bottom liquid from the rectification and then throttle expanded, before it is also fed into the rectifying column. A nitrogen product stream is taken from the head of the rectifying column and expanded to about atmospheric pressure while producing work. Most of the work obtained by expansion of the nitrogen stream is transferred to the compressor for separately compressing the second partial air stream.

This process exhibits the drawback that the nitrogen, obtained from the rectification at a pressure of about 3.3 bars, must be expanded to about atmospheric pressure in order to drive the second partial air stream compressor. If nitrogen at a higher pressure is desired by the consumer, the nitrogen must be compressed from atmospheric pressure to the desired pressure, thus increasing costs. If the nitrogen obtained at the elevated pressure from the rectification is delivered to the consumer without previous expansion, additional energy must be expended for compression of the second partial air stream, which is also uneconomical.

SUMMARY OF THE INVENTION

An object of this invention therefore is to develop an air rectification process of the type mentioned from which a high nitrogen yield can be obtained in an economical way and at superatmospheric pressure.

Upon further study of the specification and appended claims, further objects and advantages of this invention will become apparent to those skilled in the art.

The objects, according to the invention are achieved by bringing the first partial air stream, before it is fed to the rectification zone, into heat exchange with the bottom liquid from the rectification zone.

In contrast with the previously known process, according to the present invention, the first partial air stream, i.e., the one not further compressed, is used for heating the rectifying column bottoms. By heating the bottom liquid, the oxygen content in the bottom liquid is raised. At the same time the nitrogen content rises in the gas at the head of the rectifying column, so that a high nitrogen yield is guaranteed. The second partial air stream is no longer used, as in the previously known process, for heating the column bottom. After its compression, the second partial air stream is expanded while producing work. The work produced during this expansion is transferred, at least in part, to the compressor for the second partial air stream. As a result it is no longer necessary to expand the nitrogen obtained from rectification for driving the compressor. Consequently, nitrogen at elevated pressure can be obtained in an economical way by the process according to the invention. The first partial stream is preferably 30 to 50 vol % of the feed air stream, and especially 30 to 40 vol %. Thus, the second partial stream is preferably 70 to 50 vol %, especially 70 to 60 vol %.

Thus, according to a preferred feature of the invention the expansion of the second partial air stream is carried out while producing work and at least a part of the work produced during expansion is used for compression of the second partial air stream.

In a preferred further development of the process according to the invention the rectification step is performed in one stage.

In a preferred further development of the process according to the invention, nitrogen is obtained at a pressure of about 3 to 10 bars, especially about 3 to 6 bars.

Also, in a further development of the process according to the invention is it preferred that the second partial air stream, immediately prior to its expansion, exhibit a higher temperature than that of the first partial air stream immediately before its heat exchange with the bottom liquid.

In a further embodiment of the process according to the invention the bottom liquid from the rectification zone is evaporated in heat exchange with nitrogen gas thereby causing the nitrogen gas to partially condense at the head of the rectification zone. The residual gas thus resulting from evaporation of the bottom liquid is used for regenerating a purification stage used for purifying the air feed stream. The feed stream is preferably purified in units containing molecular sieves, which are regenerated by the accumulated residual gas, or at least a partial stream thereof.

An apparatus for producing nitrogen by the low-temperature rectification process according to the invention comprises a feed conduit for delivery of the air feed stream which is in fluid communication with a rectification column. At a point upstream of the rectification column, the feed conduit is connected with a branch conduit. At this point of connection the air feed stream separates into a first partial stream which continues to flow through the feed conduit and a second partial stream which flows through the branch conduit. The branch conduit delivers the second partial stream to a compressor, a heat exchanger, an expansion device, and then to the rectification column. The feed conduit, after the point of connection with the branch conduit, communicates with a first heat exchanger and then, before introducing the first partial air stream into the rectification column, communicates with a second heat exchanger wherein the first partial air stream undergoes heat exchange with the bottom liquid of the rectification column.

The second heat exchanger for the first partial air stream can be placed outside of the rectifying column, in which case its heating surfaces undergo heat exchange, on the one hand, with the bottom liquid and, on the other hand, with the gas space above the liquid. According to a preferred embodiment of the object of the invention this heat exchanger is placed in the bottom of the rectifying column.

The invention and further details of the invention are explained in greater detail by means of a diagramatically represented embodiment.

BRIEF DESCRIPTION OF THE DRAWING

Various other objects, features and attendant advantages of the present invention will be more fully appreciated as the same becomes better understood when considered in conjunction with the accompanying drawings wherein:

The FIGURE shows a diagrammatic representation of a process for production of nitrogen under increased pressure.

DETAILED DESCRIPTION OF THE DRAWING

Air 1 to be separated is compressed in a compressor 2 from about 1 bar to about 6 bars. The compressed air is fed to a purification stage 3, in which the contaminants contained in the air, particularly water and carbon dioxide, are removed. Purification stage 3 preferably comprises individual units containing molecular sieves. The units are operated in periodic alternation, alternately being loaded and regenerated.

The purified air is divided into two partial streams 4, 5. First partial air stream 5, which quantitatively is about 40 vol % of the air to be separated, is cooled in a heat exchanger 6, in heat exchange with separation products, from about 285K to about 100K. The first partial stream 5 is then further cooled and at least partially liquefied in a heat exchanger 10, which is positioned in the bottom of a rectifying column 7 and is in heat exchange with bottom liquid 11. Bottom liquid 11 is partially evaporated due to heat exchange with exchanger 10. First partial stream 5 is cooled to about 98K in exchanger 10 and then is fed into rectifying column 7.

Second partial stream 4 (about 60 vol % of the air to be separated) is further compressed in a compressor 8 to a pressure of about 7 bars and then also cooled in heat exchanger 6 in heat exchange with separation products. Second partial stream 4 is removed at an intermediate point from heat exchanger 6. Its temperature is about 120K and thus is higher than the temperature of the first partial stream at the time of its respective removal from heat exchanger 6. The second partial stream is then expanded to a pressure of about 4 bars in a turbine 9 while producing work. Second partial stream at a temperature of about 100K is then fed into rectifying column 7. The early removal of the second partial stream from heat exchanger 6 balances the heat of heat exchanger 6 and, besides, guarantees that expansion in turbine 9 does not take place under temperature which might cause partial liquefaction of the second partial stream. The work obtained in turbine 9 is transferred completely to recompressor 8.

In rectifying column 7, which is operated at a pressure of about 4 bars, a separation takes place of the air into oxygen-rich liquid 11, which collects in the bottom of the rectifying column, and a nitrogen-rich gas fraction, which collects at the head of the rectifying column. The nitrogen is removed by a pipe 17 from the head of rectifying column 7, having a purity of about 99.9999%, and is heated in heat exchanger 6 by heat exchange with the two air partial streams 4, 5, before it is discharged from the installation. The pressure of the nitrogen obtained is (aside from the pressure losses during passage through heat exchanger 6) equal to the pressure in rectifying column 7.

Oxygen-rich liquid at a temperature of 97K is taken by a pipe 12 from the bottom of rectifying column 7 and, after undergoing cooling in a heat exchanger 13, is fed at a temperature of 92K to a condenser-evaporator in the head of rectifying column 7. The oxygen-rich liquid is evaporated within the condenser-evaporator due to heat exchange with the condensing nitrogen, which trickles back in the rectifying column as reflux liquid. The resultant residual gas is taken by a pipe 14 and, after being heated in heat exchanger 13, is fed into heat exchanger 6, where it is again heated in heat exchange with air partial streams 4, 5. A part of the residual gas (pipe 15) is removed from the installation, another part (pipe 16) is fed as regeneration gas to purification stage 3.

The preferred operating pressure range for the rectifying column is about 3 to 6 bars, and for the condenser-evaporator about 1.1 to 3 bars. The liquid collecting in the head of the rectifying column has an oxygen content of about 75 vol %. If desired, a portion of said liquid may be withdrawn from the column.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for production of nitrogen by low-temperature rectification of air wherein an air feed stream is compressed and divided into a first partial stream and a second partial stream, said first partial stream is cooled and fed to an elongated vertical rectification zone having an upper part and a lower part, and a nitrogen product stream is discharged from the upper part of said rectification zone, the improvement wherein said second partial stream is separately further compressed, cooled, expanded and also fed to said rectification zone; said first partial stream, before being fed into said rectification zone, is brought into indirect heat exchange with a bottom liquid of said rectification zone; and said bottom liquid is brought into heat exchange with nitrogen gas at the head of said rectification zone whereby bottom liquid evaporates to form a residual gas and said nitrogen gas partially condenses, and at least a portion of said residual gas is used for regeneration of a purification stage for purifying said air feed stream, said purification stage being upstream of the division of said air feed stream.

2. A process according to claim 1, wherein expansion of said second partial stream results in production of work and at least a part of the work produced is used for separately compressing said second partial stream.

3. A process according to claim 2, wherein rectification is performed in one stage.

4. A process according to claim 2, wherein said nitrogen product stream is discharged from the process at a pressure of about 3–10 bars.

5. A process according to claim 2, wherein said nitrogen product stream is discharged from the process at a pressure of about 3–6 bars.

6. A process according to claim 1, wherein rectification is performed in one stage.

7. A process according to claim 6, wherein said nitrogen product stream is discharged from the process at a pressure of about 3–10 bars.

8. A process according to claim 6, wherein said nitrogen product stream is discharged from the process at a pressure of about 3–6 bars.

9. A process according to claim 1, wherein said nitrogen product stream is discharged from the process at a pressure of about 3–10 bars.

10. A process according to claim 1, wherein said nitrogen product stream is discharged from the process at a pressure of about 3–6 bars.

11. A process according to claim 1, wherein said second partial stream, immediately prior to its expansion, exhibits a higher temperature than exhibited by said first partial stream immediately before said first partial stream is brought into heat exchange with said bottom liquid.

12. A process according to claim 1, wherein, after its expansion, said second partial stream is fed directly to said rectification zone.

13. A process according to claim 1, wherein said heat exchange between said first partial stream and said bottom liquid is conducted within the lower part of said rectification zone.

14. A process according to claim 1, wherein said bottom liquid, prior to its heat exchange with nitrogen gas, undergoes heat exchange with said residual gas.

15. The process according to claim 1, wherein said partial stream is expanded in a turbine.

16. An apparatus for production of nitrogen by low-temperature rectification, comprising:

a first compressing means for compressing an air feed stream; a single-stage rectification column; a feed conduit in fluid communication with said first compressor and said rectification column; a branch conduit connected to said feed conduit upstream of said rectification column for dividing the air feed stream into a first partial stream, which flows through said feed conduit, and a second partial stream, which flows through said branch conduit; said branch conduit communicating with a second compressing means, a heat exchange means for cooling said second partial stream, expansion means for expanding resultant cooled second partial stream, and said rectification column; said feed conduit communicating with a heat exchange means wherein said first partial stream undergoes heat exchange with separation products from said rectification, and communicating with a second heat exchange means, prior to delivery of said first partial stream to said rectification column, wherein said first partial stream undergoes heat exchange with a bottom liquid from said rectification column;

wherein an upper section of said rectification column is provided with an evaporator-condenser for evaporating a bottom liquid from said rectification column to form a residual gas stream and for partially condensing nitrogen gas; and further comprising conduit means communicating with the bottom of said rectification column and heat exchange means wherein bottom liquid from said rectification column undergoes heat exchange with said residual gas stream prior to evaporation of said bottom liquid in said evaporator-condenser.

17. An apparatus according to claim 16, wherein said second heat exchange means is positioned in a bottom section of said rectification column.

18. An apparatus according to claim 16, wherein an upper section of said rectification column is provided with an evaporator-condenser for evaporating a bottom liquid from said rectification column to form a residual gas stream and for partially condensing nitrogen gas.

19. An apparatus according to claim 16, wherein nitrogen gas is removed from the apparatus without being subjected to further expansion.

20. An apparatus according to claim 16, wherein said second compressor means is connected to said expansion means whereby work produced by expansion of said second partial stream is used for operating said second compressor means.

* * * * *